US012234705B2

(12) United States Patent
Da Silva et al.

(10) Patent No.: US 12,234,705 B2
(45) Date of Patent: Feb. 25, 2025

(54) METHOD FOR APPLYING THE SCALE INHIBITOR TO COMPLETION FLUIDS DURING INJECTIVITY TEST OPERATIONS

(71) Applicant: PETRÓLEO BRASILEIRO S.A.—PETROBRAS, Rio de Janeiro (BR)

(72) Inventors: Mario Germino Ferreira Da Silva, Rio de Janeiro (BR); Valtair Marcos Cristante, Rio de Janeiro (BR); Fernando Antonio Moreira Da Silva, Rio de Janeiro (BR); Ciro Dos Santos Guimaraes, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 18/493,160

(22) Filed: Oct. 24, 2023

(65) Prior Publication Data

US 2024/0133268 A1 Apr. 25, 2024
US 2024/0229605 A9 Jul. 11, 2024

(30) Foreign Application Priority Data

Oct. 25, 2022 (BR) ..... 1020220216347

(51) Int. Cl.
*E21B 37/06* (2006.01)
*E21B 49/00* (2006.01)

(52) U.S. Cl.
CPC ..... *E21B 37/06* (2013.01); *E21B 49/008* (2013.01)

(58) Field of Classification Search
CPC ..... E21B 37/06; E21B 49/008
See application file for complete search history.

(56) References Cited

U.S. PATENT DOCUMENTS

| | | | | |
|---|---|---|---|---|
| 4,860,829 | A | 8/1989 | Carlberg et al. | |
| 5,224,543 | A * | 7/1993 | Watkins | C09K 8/528 507/224 |
| 11,584,878 | B1 * | 2/2023 | Yue | E21B 37/06 |
| 2009/0025933 | A1 * | 1/2009 | Garcia-Lopez de Victoria | C09K 8/74 507/221 |
| 2010/0047156 | A1 * | 2/2010 | Priel | C02F 1/441 210/201 |
| 2014/0251626 | A1 * | 9/2014 | Gomaa | E21B 43/26 166/308.5 |

FOREIGN PATENT DOCUMENTS

| | | |
|---|---|---|
| BR | 0108245 A | 11/2022 |
| EP | 0040442 B1 | 8/1983 |

* cited by examiner

*Primary Examiner* — Silvana C Runyan
(74) *Attorney, Agent, or Firm* — Troutman Pepper Locke LLP

(57) ABSTRACT

The present invention relates to a method for applying scale inhibitor to completion fluids during injectivity test operations. Said method takes advantage of the completion fluid to inhibit scaling in the reservoir by filling the porous spaces of the reservoir rock with the inhibited completion fluid. When the well is put into production, this inhibited fluid positioned inside the reservoir will be produced together with the oil and will inhibit the formation of scale inside the reservoir and on production equipment.

6 Claims, 1 Drawing Sheet

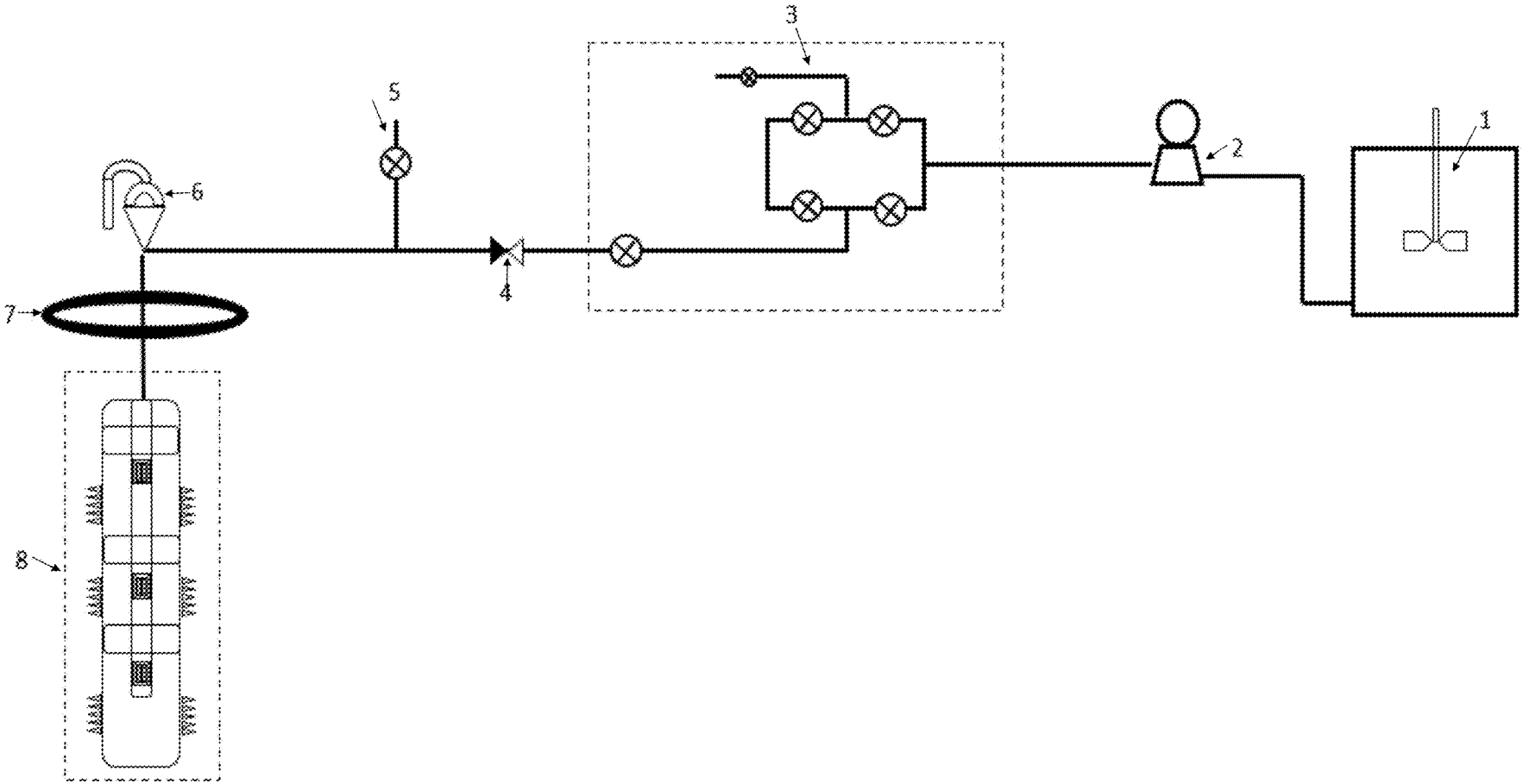
1
2
3
4
5
6
7
8

METHOD FOR APPLYING THE SCALE INHIBITOR TO COMPLETION FLUIDS DURING INJECTIVITY TEST OPERATIONS

CROSS-REFERENCE TO RELATED APPLICATION

This application claims, under 35 U.S.C. § 119(a), priority to and the benefit of Brazilian Patent Application No. 10 2022 021634 7, filed Oct. 25, 2022, which is incorporated by reference herein in its entirety.

FIELD OF THE INVENTION

The present invention pertains to the field of reservoir management, more precisely in the field of controlling production losses through scale management, and refers to a method for applying scale inhibitor to completion fluids during injectivity test operations.

BACKGROUNDS OF THE INVENTION

The motivation for the invention originates from the need for chemical inhibition of the reservoir. To determine the injectivity index (II) of the well, an injectivity test is carried out, in which large volumes of fluid are injected until sufficient pressure data is obtained to generate a reliable curve from which the (II) will be estimated, among other reservoir parameters. The idea is to place a scale inhibitor in the formulation of the completion fluid that will be used during injectivity test operations in the completed wells, both in siliciclastic and carbonate formations, as is the case in the pre-salt.

Thus, while the reservoir absorbs the fluid used in the fluid injection operation into the reservoir, during the injectivity test operation, the fluid with the scale inhibitor will be positioned inside the reservoir, thus generating a chemical inhibition of scale formation inside the reservoir.

The approach generally previously used to solve the problem of the need to inhibit reservoirs in order to avoid the formation of scale, was simply the use of chemical inhibition through squeeze of inhibitor in reservoirs; however, this operation normally requires a stoppage to be carried out well production so that the inhibitor squeeze can be injected into the producing formation; next, an adsorption time of the inhibitor by the reservoir rock is necessary. After the adsorption time has elapsed, when the source rock adsorbs part of the scale inhibitor, the excess thereof is produced when the well is opened for production. This adsorption time is controlled to prevent damage to the reservoir from occurring. During the oil production, the inhibitor fluid that was adsorbed by the reservoir rock will begin a chemical desorption process, that is, it will be gradually released, thus inhibiting scale formation together with the water produced in the BSW of the oil produced.

The solution achieved by the invention will be the use of the completion fluid used in injectivity test operations, to inhibit scaling in the reservoir by filling the porous spaces of the reservoir rock with the inhibited completion fluid. When the well is put into production, this inhibited fluid positioned inside the reservoir will be produced together with the oil and will inhibit the formation of scale inside the reservoir and on production equipment.

The completion fluid is the fluid that is used in the construction phase of an oil well called completion, which corresponds to the preparation of the well to be equipped with completion equipment, such as the production string, production packers, flow valves that connect the well annulus to the interior of the oil well production string, chemical injection mandrels for dosing products, PDG sensors to measure temperature and pressure, the safety valve that is the down hole safety valve (DHSV) and wet Christmas tree.

The fluid is defined as a function of the hydrostatic pressure that it must exert on the producing formation, its main function is to keep the well damped, that is, to not allow the production of oil from the reservoir into the oil well, during the completion operations, that is, the running in and installation of production equipment in the well. The density of the fluid in Lb/gal is multiplied by the vertical depth, (TVD, true vertical depth) of the well in meters, times 0.17 (unit and gravity conversion).

STATE OF THE ART

Document EP 0040442 B1 describes a well treatment process comprising the composition of an aqueous solution containing scale inhibitor consisting essentially of water, at least one compound containing scale inhibitor anions, at least one compound containing multivalent cations, alkaline material sufficient to provide a solution pH that exceeds the pH at which a compound of these scales—inhibitory anions and multivalent cations will begin to precipitate at the reservoir temperature, and a sufficient quantity of at least one compound that reacts to produce hydrogen ions at a relatively slow rate to subsequently reduce the pH of the solution to one at which said precipitation will begin; and injecting the solution into the reservoir at a rate and volume arranged so that (a) substantially all of the solution enters the reservoir before any significant amount of said precipitation occurs and (b) a significant amount of said precipitation occurs while the solution is in a location close to the well inside the reservoir. It further mentions that, although a wide variety of materials inhibit crystal growth, the most commonly used compounds in well treatments are organic phosphates or phosphonates or acrylic acid adducts or similar.

Document PI 0108245-0 A refers to a method of treating a reservoir zone of a hydrocarbon producing well during the completion phase to inhibit problems associated with water production, the method comprising: deploying, in the region near the well of a reservoir zone during the completion phase, a hydrocarbon-compatible treatment agent in a hydrocarbon phase; allowing the active component of the treatment agent to irreversibly enter the connate water in the well region; and allowing the active component to be retained by the source rock in the well region, whereby the active component of the treatment agent actively inhibits the respective problem if and when water is ultimately produced from the reservoir zone.

Document U.S. Pat. No. 4,860,829 A relates to a treatment process for inhibiting scale by fluid that is produced from a non-carbonate underground reservoir through a wellbore, which comprises injecting into the wellbore and the reservoir a mixture of a phosphonate scale inhibitor compound and a calcium chelate, wherein the calcium chelate has a lower stability constant (Ke) than the phosphonate inhibitor.

The method proposed in the present invention, in a different way to the state of the art, may serve as a prior option for programming the squeeze operation in a reservoir, even in the well construction phase, in the completion step, in the injectivity test operations, having the technical advantage of taking advantage of the completion fluid that the well will absorb to perform a prior inhibition of the reservoir, thus using the porous spaces of the reservoir rock to reserve inhibited completion fluid, which will then be available within the reservoir to perform an inhibition scale, when producing oil from this reservoir.

Additionally, the technology proposed in the present invention can be applied entirely through the Wells field, being addressed to the Reservoirs field for scaling management and, in the Lift and Flow field, it will contribute to ensuring the flow of production from the wells. It can be applied as part of the technology used in the construction of wells in the completion phase in injectivity test operations as part of the technology used in the completion fluids, wherein only the planning of the addition of the inhibitor chemical product in the manufacture of the completion fluid is required.

SUMMARY OF THE INVENTION

The present invention aims at proposing a method for applying scale inhibitor to completion fluids during injectivity test operations comprising the following steps: (a) definition of the function and type of the completion fluid (generally water-based fluids, which can be desulfated, industrial water or seawater); (b) selection of inhibitor compatible with the completion fluid and rock formation; (c) sizing of the volume of scale inhibitor to be consumed; (d) incorporation of the inhibitor into the fluid in a tank or mixer present in the marine rig.

BRIEF DESCRIPTION OF THE FIGURES

FIG. 1 presents the circulation system of a completion rig, in which the scale inhibitor is applied.

DETAILED DESCRIPTION OF THE INVENTION

The present invention relates to a method for applying the scale inhibitor to completion fluids during injectivity test operations, comprising the following steps:

(a) definition of the function and type of the completion fluid (generally seawater-based fluids);

(b) selection of inhibitor compatible with the completion fluid and rock formation;

(c) sizing of the volume of scale inhibitor to be consumed;

(d) incorporation of the inhibitor into the fluid in a tank or mixer present in the marine rig.

In the injectivity test operations, the completion fluid is prepared according to the operation program. This completion fluid is displaced until it reaches the perforations. The scale inhibitor will be added to the completion fluid that will be absorbed by the producing formation during the operation against losses, and in this way the inhibitor will be positioned inside the reservoir, and thus the reservoir will be inhibited. While the reservoir absorbs the fluid used in the fluid injection operation into the reservoir during the injectivity test operation, the completion fluid with the scale inhibitor will be positioned inside the reservoir, thus generating a chemical inhibition of scale formation within the reservoir.

The selection of the inhibitor is carried out through the following tests: static compatibility test, flow test in capillary, flow test in porous medium. Table 1 shows the tests for inhibitor selection.

TABLE 1

Tests for inhibitor selection.

| Type of Test | Obtained Result | Note |
|---|---|---|
| Static compatibility test | Scale inhibitor and formation water are compatible | No precipitation or turbidity of water occurred when compared to blank test (with formation water only) |
| Flow test in capillary | No inhibitor precipitation occurs under flow conditions as a function of time | Determination of the minimum inhibitor concentration that must be used to guarantee the effectiveness of the process |
| Flow test in porous medium | Test with the reservoir rock plug to obtain the adsorption isotherm that will be used to size the volumetries that will be applied in the treatment | Obtaining the absorption isotherm is essential to obtain the duration of the treatment |

Thus, the preferably-used scale inhibitors are the organophosphate compounds, and are incorporated directly into the completion fluid that will be used to carry out the injectivity test, with a concentration between 50 and 20000 ppm in the injectivity test fluid, four pumpings of 20 minutes, wherein there are two of 20 bpm×20 minutes and two of 10 bpm×20 minutes, which totals 600 bbl, and, in this volume, from 4.77 liters to 1900 liters will be the inhibitor, as follows:

Pumping 20 $m^3$/d of seawater between 50 and 20000 ppm of scale inhibitor for 20 min, followed by monitoring the pressures and temperatures during this pumping;

Pumping 20 $m^3$/d of seawater between 50 and 20000 ppm of scale inhibitor for 20 min, followed by monitoring the pressures and temperatures during this pumping;

Pumping 10 $m^3$/d of seawater between 50 and 20000 ppm of scale inhibitor for 20 min, followed by monitoring the pressures and temperatures during this pumping;

Pumping 10 $m^3$/d of seawater between 50 and 20000 ppm of scale inhibitor for 20 min, followed by monitoring the pressures and temperatures during this pumping.

This will be obtained by adding the inhibitor to the completion fluid, which will be prepared in a tank on the completion platform.

The incorporation of the completion fluid is carried out in the circulation system of a completion rig, including the completion rig pumping system, which are the equipment used during operations with completion fluid, and which are used, such as the rig tanks for fluid preparation. Said system, represented by FIG. 1, presents the following equipment:

Fluid supply tank (1): place where the fluid is prepared and stored until it is used. It has a stirrer for homogenizing the fluid;

Rig pump (2): used to pump fluids from the tank to the oil well;

Standpipe manifold (3): used to align fluids to be pumped between different equipment, from tanks and/or filtration units and also to the oil well;

Check valve (4): used to prevent the return of fluid, through the alignment that goes to the well, towards equipment such as pump and/or filtration unit;

Relief line (5): used to divert fluid flow with the functions of unloading or decompressing unwanted pressure in the pumping lines;

Injection head (6): used at the upper end of the string, for connection with the pumping lines, which has flexibility to allow the movement of the string inside the well, in movements resulting from swell and river.

Rotary table (7): it is positioned on the floor of the rig, whose function is to allow access to the drilling and/or completion string to carry out operations inside the well, such as, for example, connecting the pipes both of drilling and completion string.

Well Scheme (8): represents a schematic drawing of the well components, such as casings, perforations to connect the reservoir to the interior of the well, isolation packers, production string and flow valves positioned at intervals.

This system also presents the feasibility of carrying out the pre-inhibition by injecting the chemical product into the marine well, during the injectivity test operation to enable the pre-inhibition to be carried out.

Advantages of the Invention

Reliability

It improves the guarantee of production flow by preventing the early formation of scale, which increases well productivity time without the need for intervention, thus avoiding production losses associated with scales.

Social

It collaborates in maintaining the payment of oil royalties in order to promote the maintenance of production and avoid production losses.

Economic/Productivity

It prevents losses in oil production in the case of the generation of incompatible mixtures with a high potential for scale formation arising from the mixture of the fluid injected into the reservoir with water from the aquifer, thus avoiding the financial loss associated with loss of production. Carrying out a removal and inhibition operation to eliminate the damage process caused by scale necessarily generates a production stoppage of the oil well for at least 5 days; considering the average production of a well in Búzios of 8000 $m^3$/d and considering the barrel at US$96, it would bring savings of R$24,000,000.00 per day.

It reduces the number of interventions with stimulation boats, generating savings of R$9,000,000.00 per operation carried out for the Búzios field.

It avoids rig interventions during the field development phase. Depending on the type of scale that may be formed, it could be necessary to use a completion rig to remove the scale using equipment with coiled tubing and drill associated with chemical chelators such as DTPA and/or EDTA. Considering that the average time for this type of operation lasts around 15 days, and that the average rig daily is around US$500,000.00 per day, there would be a saving of R$ 37,500,000.00.

Health/Safety

It reduces the need for operations with stimulation boats to pump scale-removing solutions from the well production string and to carry out inhibitor squeeze operations. In this way, there is a reduction in the risk associated with disconnections in the pumping system of the stimulation boats and the possibility of chemical leaks into the sea.

Other Advantages

It improves scaling management and thus contributes to increasing the efficiency of the reservoir management in the fields in which this technology is applied.

Environmental

It reduces $CO_2$ emissions due to the reduction in the need of using a WSSV-type vessel to carry out scale removal and inhibitor squeeze operations.

The invention claimed is:

1. A method for applying a scale inhibitor to one or more completion fluids to be used during injectivity test operations, the method comprising (a) defining a function and a type of one or more completion fluids;

(b) selecting a scale inhibitor compatible with the one or more completion fluids and rock formation;

(c) sizing of a volume of the scale inhibitor to be consumed; and (d) incorporating the scale inhibitor directly into the one or more completion fluids in a tank or mixer present in a marine rig by:

providing seawater;

pumping, into a reservoir, 20 $m^3$/d of the seawater with between 50 and 20000 ppm of the scale inhibitor for 20 min in a first pumping, followed by monitoring pressures and temperatures of the reservoir during the first pumping;

pumping, into the reservoir, 20 $m^3$/d of the seawater containing 50 to 20,000 ppm of the scale inhibitor for 20 min in a second pumping, followed by monitoring pressures and temperatures of the reservoir during the second pumping;

pumping, into the reservoir, 10 $m^3$/d of the seawater containing 50 to 20,000 ppm the scale inhibitor for 20 min in a third pumping, followed by monitoring of pressures and temperatures of the reservoir during the third pumping; and pumping, into the reservoir, 10 $m^3$/d of the seawater containing 50 to 20,000 ppm of the scale inhibitor for 20 min in a fourth pumping, followed by monitoring pressures and temperatures of the reservoir during the fourth pumping, wherein there is a total of 600 bbl of the seawater and scale inhibitor with 4.77 liters to 1900 liters of scale inhibitor in the first, second, third, and fourth pumpings, and wherein the scale inhibitor comprises organophosphate compounds.

2. The method according to claim 1, wherein the one or more completion fluids are defined as a function of exerted hydrostatic pressure, not allowing production of oil from the reservoir into an oil well, during the injectivity test operations.

3. The method according to claim 1, wherein selecting the scale inhibitor is carried out by one or more of a static compatibility test, a flow test in capillary, a flow test in porous medium, or combinations thereof.

4. A method for applying a scale inhibitor to one or more completion fluids to be used during injectivity test operations, the method comprising:

(a) defining a function and a type of one or more completion fluids;

(b) selecting a scale inhibitor compatible with the one or more completion fluids and rock formation;

(c) sizing a volume of the scale inhibitor to be consumed; and (d) incorporating the scale inhibitor into the one or more completion fluids in a tank or mixer present in a marine rig by:

providing seawater;

pumping, into a reservoir, 20 $m^3$/d of the seawater with between 50 and 20000 ppm of the scale inhibitor for 20 min in a first pumping;

monitoring pressures and temperatures of the reservoir during the first pumping;

pumping, into the reservoir, 20 $m^3$/d of the seawater containing 50 to 20,000 ppm of the scale inhibitor for 20 min in a second pumping, followed by monitoring pressures and temperatures of the reservoir during the second pumping;

pumping, into the reservoir, 10 $m^3$/d of the seawater containing 50 to 20,000 ppm the scale inhibitor for 20 min in a third pumping, followed by monitoring of pressures and temperatures of the reservoir during the third pumping; and pumping, into the reservoir, 10 $m^3$/d of the seawater containing 50 to 20,000 ppm of the scale inhibitor for 20 min in a fourth pumping, followed by monitoring pressures and temperatures of the reservoir during the fourth pumping.

5. The method according to claim 4, wherein there is a total of 600 bbl of the seawater and scale inhibitor with 4.77 liters to 1900 liters of scale inhibitor in the first, second, third, and fourth pumpings.

6. The method according to claim 5, wherein the scale inhibitor comprises organophosphate compounds.

* * * * *